US005848563A

United States Patent [19]

Saito

[11] Patent Number: 5,848,563

[45] Date of Patent: Dec. 15, 1998

[54] MULTIPLE TOOL FOR PUNCH PRESS

[75] Inventor: Hiroshi Saito, Tokyo, Japan

[73] Assignee: Amada Metrecs Company Limited, Japan

[21] Appl. No.: 883,962

[22] Filed: Jun. 27, 1997

Related U.S. Application Data

[63] Continuation of Ser. No. 398,685, Mar. 6, 1995, abandoned, which is a continuation-in-part of Ser. No. 93,681, Jul. 20, 1993, abandoned.

[30] Foreign Application Priority Data

Jul. 21, 1992 [JP] Japan ..... 4-193544
Dec. 6, 1994 [JP] Japan ..... 6-301831

[51] Int. Cl.[6] ..... B26D 5/08

[52] U.S. Cl. ..... 83/552; 83/571

[58] Field of Search ..... 83/140, 552, 571

[56] References Cited

U.S. PATENT DOCUMENTS

| | | | |
|---|---|---|---|
| 2,168,377 | 8/1939 | Wales | 83/140 |
| 3,125,917 | 3/1964 | Smeets | 83/140 |
| 3,205,742 | 9/1965 | Williamson | 83/140 |

(List continued on next page.)

FOREIGN PATENT DOCUMENTS

| | | | |
|---|---|---|---|
| 703444 | 2/1965 | Canada | 83/140 |
| 0 396 817 | 11/1990 | European Pat. Off. . | |
| 0 399 338 | 11/1990 | European Pat. Off. . | |

(List continued on next page.)

OTHER PUBLICATIONS

European Search Report dated Sep. 29, 1993, for Application No. EP 93 11 1604.

Copy of European Search Report dated Sep. 29, 1993 for Appln. No. EP 93 11 1604.

*Primary Examiner*—M. Rachuba

*Attorney, Agent, or Firm*—Blank Rome Comisky & McCauley LLP

[57] ABSTRACT

A multiple tool is disclosed wherein during a punching process by a predetermined punch, a workpiece is not damaged by other punches not used therein. A multiple tool is mounted on a rotatable holder (7) supported in a freely rotatably driven manner on a holder body (3) such as an upper turret. The multiple tool includes a punch holder (231), and a plurality of punches (241) supported in a vertically movable manner on the punch holder, and a striker plate (261) provided in the punch holder (231) in a rotatable and vertically movable manner relative to the punch holder (231). The striker plate is formed (a) on a lower surface thereof with a peripheral groove (271) for engaging the heads of the punches, and (b) above a predetermined location along the peripheral groove with a striker section (273) for selectively striking one of the punches on the punch holder, and (c) above a plurality of predetermined locations along the peripheral groove with through-holes (271H) for allowing the heads of the punches other than the punch struck by the striker section to move upward relative to the striker plate during a punching process by the punch struck by the striker section. The multiple tool further includes a punch head holder (255) provided above a striker plate (261) so as to be vertically movable relative to the striker plate and to be prevented from rotating relative thereto. A backup pin (275) is provided in the punch head holder at a position above each through-hold (271H), so that the head of each punch is pressed downward by a lower end of the backup pin (275). A pressure spring (279) is provided between the punch head holder and a backup pin for urging the backup pin downward. A holder spring (249) is provided between the punch guide (253) and the punch (241), for urging the punch upward. The spring constant of the holder spring (249) is greater than the spring constant of the pressure spring (279).

5 Claims, 6 Drawing Sheets

U.S. PATENT DOCUMENTS

| | | | |
|---|---|---|---|
| 3,527,130 | 9/1970 | Knehans . | |
| 3,902,389 | 9/1975 | Brown et al. | 83/552 X |
| 3,935,771 | 2/1976 | Cady, Jr. | 83/140 |
| 4,007,653 | 2/1977 | Cady . | |
| 4,092,888 | 6/1978 | Wilson | 83/140 |
| 4,250,785 | 2/1981 | Morishita et al. . | |
| 4,375,774 | 3/1983 | Wilson et al. | 83/140 |
| 4,457,196 | 7/1984 | Cady | 83/140 |
| 4,532,845 | 8/1985 | Jinnouchi | 83/685 X |
| 4,555,966 | 12/1985 | Klingel | 83/571 X |
| 4,569,267 | 2/1986 | Klingel | 83/571 X |
| 4,862,782 | 9/1989 | Ernst | 83/552 |
| 4,929,276 | 5/1990 | Chun et al. | 83/552 |
| 4,976,180 | 12/1990 | Otto . | |
| 4,998,958 | 3/1991 | Chun et al. | 83/552 X |
| 5,012,712 | 5/1991 | Nordquist | 83/571 |
| 5,048,385 | 9/1991 | Eckert et al. | 83/571 |
| 5,062,337 | 11/1991 | Johnson et al. | 83/552 |
| 5,072,620 | 12/1991 | Hill et al. | 83/571 |
| 5,390,575 | 2/1995 | Saito | 83/571 X |

FOREIGN PATENT DOCUMENTS

| | | |
|---|---|---|
| 0396817 | 11/1990 | European Pat. Off. . |
| 0399338 | 11/1990 | European Pat. Off. . |
| 0 579 217 A1 | 1/1994 | European Pat. Off. . |
| 579217 | 1/1994 | European Pat. Off. . |
| 580124 | 1/1994 | European Pat. Off. . |
| 63-34754 | 4/1985 | Japan . |
| 60-82231 | 5/1985 | Japan . |
| 1-23627 | 8/1985 | Japan . |
| 63-34754 | 9/1988 | Japan . |
| 1-23627 | 7/1989 | Japan . |
| 6-31356 | 2/1994 | Japan . |

MULTIPLE TOOL FOR PUNCH PRESS

RELATED APPLICATION

This application is a continuation of Ser. No. 08/398,685, filed Mar. 6, 1995, now abandoned, which is a continuation-in-part of Ser. No. 08/093,681, filed Jul. 20, 1993, now abandoned.

BACKGROUND OF THE INVENTION

1. Field of the Invention

The present invention relates to a multiple tool for punch press which is provided with a plurality of punches of different shapes and dimensions, and, in particular, to a multiple tool provided with a punch holder for supporting the plurality of punches so as to be movable in the vertical direction, and punching means rotatable relative to the punch holder and able to be positioned above any one punch of the plurality of punches.

2. Description of the Prior Art

An example of a conventional multiple tool is disclosed in U.S. Pat. No. 5,048,385. This conventional multiple tool includes a cylindrical stripper guide supported on a rotatable turret in a manner allowing free rotation and free vertical movement. A disk-shaped punch carrier is vertically movably supported by the stripper guide through a spring which is freely compressible vertically. A plurality of punches are provided on the punch carrier in a circumferentially spaced manner. A ring-shaped striker body is provided on the punch carrier, capable of free rotation relative to the punch carrier. Formed on the lower end of the striker body are a striker member for striking a head of one punch among the plurality of punches and a relieved area for permitting punches other than the selected punch to move upward during the punching with the selected punch. In addition, skid posts arc provided in the relieved area for urging the punches downward to prevent the inactive punches from bouncing upward during punching.

However, the above-mentioned multiple tool has the drawback that a punch which is not being used in the punching operation projects downward from the stripper guide by being pushed downward by the skid posts and can damage the workpiece.

In addition, the support of the plurality of punches is not necessarily stable because these punches are supported by the punch carrier and the stripper guide which are movable vertically relative to each other. This causes the problem that the vertical axes of the punches are not necessarily lined up properly.

SUMMARY OF THE INVENTION

Accordingly, an object of the present invention is, with due consideration to the drawbacks of such conventional apparatus, to provide a multiple tool wherein a workpiece is not damaged by punches not used in a punching processing.

This object of the present invention is achieved by the provision of a multiple tool mounted on a rotatable holder supported in a freely rotatably driven manner on a holder body such as an upper turret of a turret punch press. The multiple tool includes a punch holder, and a plurality of punches supported in a vertically movable manner on the punch holder, each punch having a head. A striker plate is provided in the punch holder in a rotatable and vertically movable manner relative to the punch holder. The striker plate is formed (a) on lower surface thereof with a peripheral groove for engaging the heads of the punches, and (b) above a predetermined location along the peripheral groove with a striker section for selectively striking one of the punches on the punch holder, and (c) above a plurality of locations along the peripheral groove with through-holes for allowing the heads of the punches other than the punch struck by the striker section to move upward relative to the striker plate during punching. A punch head holder is provided above a striker plate in such a way as to be vertically movable and prevented from rotating relative to the striker plate. Backup pins are provided at positions in the punch head holder each located above each through-holes, so that the lower end of each backup pin abuts the head of each punch tool located under the through-hole. A pressure spring is provided between the the punch head holder and a backup pin for urging the backup pin downward, so that the head of each punch is pressed downward by a lower end of the backup pin. A holder spring is provided between the punch holder and the punch, for urging the punch upward relative to the punch holder. The spring constant of the holder spring is selected to be greater than that of the pressure spring.

A further object of the present invention is to provide a multiple tool wherein the striker plate is prevented from being removed from the punch holder.

This object of the present invention is achieved by the provision of the multiple tool which further includes an upward movement restraining member for preventing the vertical movement of the striker plate with respect to the punch holder. The upward movement restraining member is vertically movable relative to the punch holder or the striker plate.

In the configuration above, when the punch holder rotates relative to the striker plate, the punches supported on the punch holder move relative to the striker plate. Accordingly, after a suitable punch has been indexably moved to a position beneath the striker section of the striker plate, the punch can be struck by the striker section to perform a punching operation in cooperation with a die corresponding to that punch. At this time, since the spring constant of the holder spring is greater than the spring constant of the pressure spring, punches other than the selected punch for performing the punching operation do not project below the lower surface of the punch holder, and therefore the workpiece subjected to the punching is not damaged by the inactive punches.

In a preferred embodiment, an elastic member is further provided between the punch holder and the striker plate for urging the striker plate upward relative to the punch holder. Thus the striker plate is normally positioned at a predetermined height with respect to the punch holder so that the heads of the punches can be reliably located within the peripheral groove without being extended into the through-hole. Accordingly, the striker plate can be easily rotated relative to the punch holder, and the assembly of the multiple tool can be easily performed.

Further, in a further preferred embodiment, the lower end of each punch is guided in a vertically movable manner by a solid presser plate. Accordingly, possible lateral displacement of the lower end of the punch during punching processing is prevented even when a lateral component force is received by the punch for example during a nibbling operation. Thus a possible galling between the lower end of the punches and the dies can be prevented.

BRIEF DESCRIPTION OF THE DRAWINGS

These and other objects, features, and advantages of the present invention will become more apparent from the following description of the preferred embodiments taken in conjunction with the accompanying drawings, in which.

DETAILED DESCRIPTION OF THE PREFERRED EMBODIMENTS

Other features of this invention will become apparent in the course of the following description of exemplary embodiments which are given for illustration of the invention and are not intended to be limiting thereof.

Figure 1:
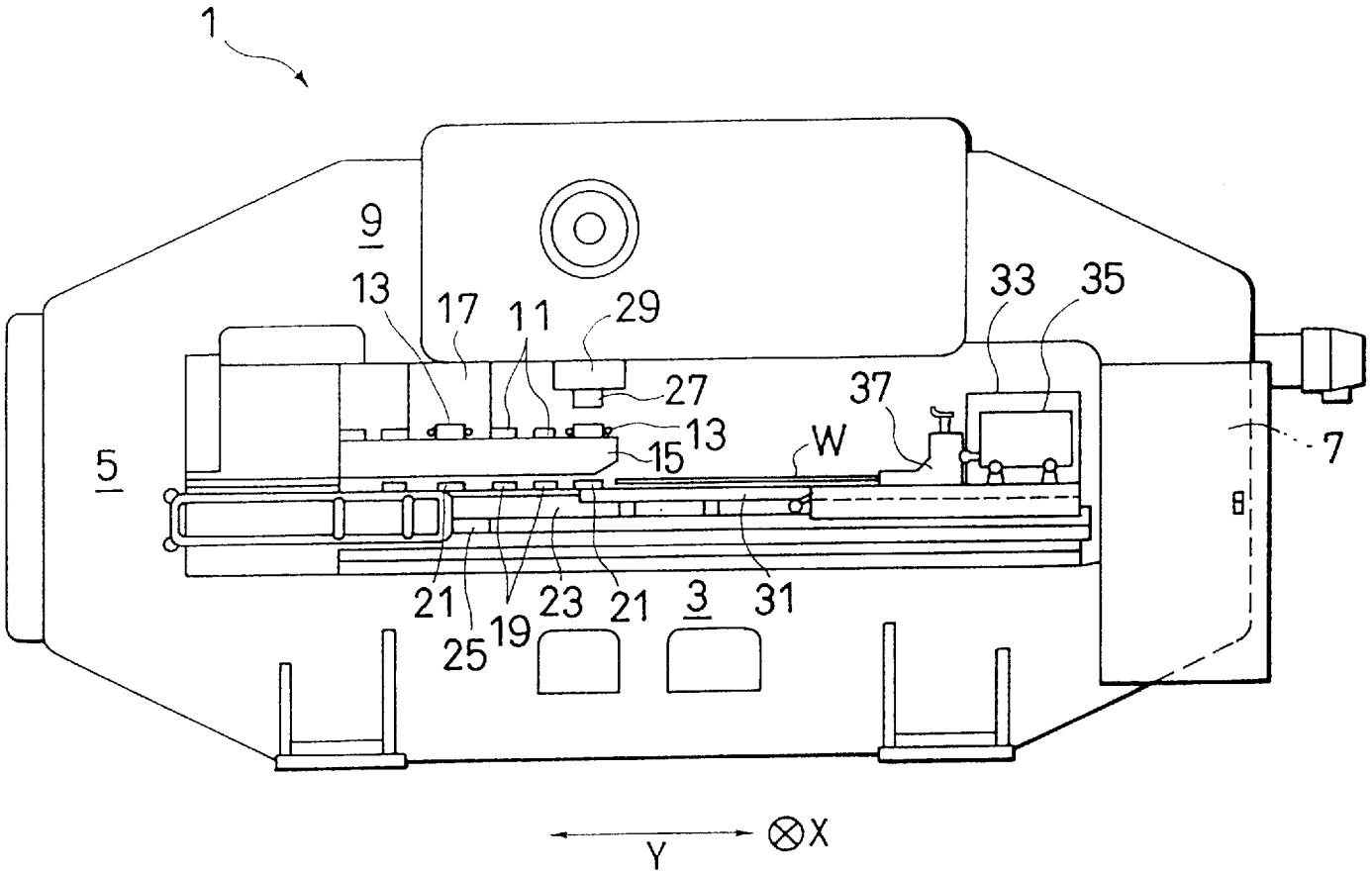
FIG. 1 is a front view of a turret punch press on which embodiments of a multiple tools according to the present invention is mounted.

FIG. 1 shows a turret punch press 1 as an example of the punch press, on which embodiments of a multiple tools according to the present invention is mounted. This turret punch press 1 includes a base 3, two column frames 5 and 7 provided vertically on both sides of the base 3, and an upper frame 9 provided on the upper side of the column frames 5 and 7.

Further, a disk-shaped upper turret acting as upper tool holding body 15 is provided on the upper frame 9 so as to be rotatable about an upper rotary shaft 17. In the same way, a lower disk-shaped turret acting as lower die holding body 23 is provided on the base 3 so as to be rotatable about a lower rotary shaft 25 in oppositional positional relationship with respect to the upper turret 15. Conventional punches 11 and a punch assembly 13 are removably attached to the upper turret 15, as upper tools.

Similarly, conventional dies 19 and a die assembly 21 are removably attached to the lower turret 23, as lower tools. The punch assembly 13 include a plurality of small punches arranged circularly and the die assembly 21 includes a plurality of dies also arranged circularly according to the present invention, as described in detail hereinafter. The upper conventional punch 11 and the lower conventional die 19 form a pair of tools, and the punches of the punch assembly 13 and the dies of the die assembly 21 form a plurality of pairs of tools. Further, a ram 29 having a striker 27 is provided on the upper frame 9 so as to be movable up and down to selectively strike the conventional punches 11 or the punch assembly 13.

The upper turret 15 and the lower turret 23 are both controllably rotated by a turret servomotor (not shown) mounted on the frame. Thus a pair of any required conventional punch 11 and conventional die 19 or a pair of punch assembly 13 and die assembly 21 can be selectively moved to a punching position under the striker 27.

Further, a fixed table (not shown) is provided at the middle upper portion of the base 3 in the X-axis direction which is perpendicular to the sheet of the drawing of FIG. 1. A pair of movable tables 31 are supported on both sides of the fixed table in the X-axis direction. The pair of movable tables 31 are movable in the Y-axis direction (in lateral direction in FIG. 1). Further, a carriage base 33 is fixed to the movable table 31 in such a way as to straddle the fixed table. Further, the carriage base 33 is provided with a carriage 35 so as to be movable in the X-axis direction. Further, the carriage 35 is provided with a work clamp 37 for clamping an end of a plate-shaped workpiece W.

Thus the workpiece W can be located between the upper turret 15 and the lower turret 23 by moving the movable table 31 in the Y-axis direction and the carriage 35 in the X-axis direction.

The workpiece W located as described above can be punched by a pair of any required conventional punch 11 and die 19, or by a pair of punch and die in the punch and die assemblies 13 and 21, which are selectively located under the striker 27 by rotating the upper turret 15 and the lower turret 23.

Figure 2:
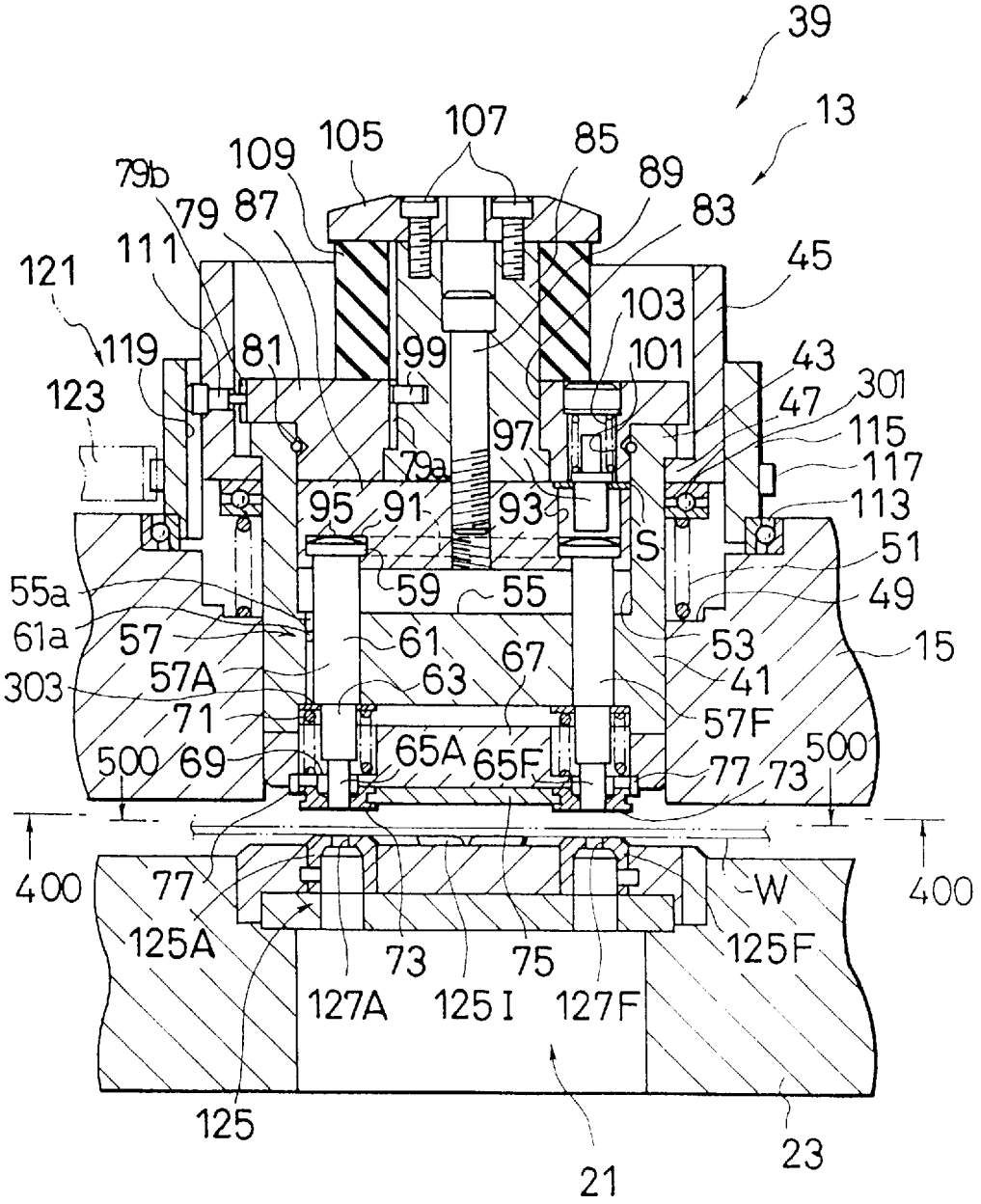
FIG. 2 is a cross-sectional view showing a first embodiment of a multiple tool according to the present invention.

With reference to FIG. 2, a first embodiment of the multiple tool 39 for the punch press according to the present invention will be described in detail hereinbelow. The multiple tool 39 includes the punch assembly 13 and the die assembly 21 described in the above. The punch assembly 13 is provided with a cylindrical punch holder 41 supported by the upper turret 15 so as to be movable only up and down. Although not shown in the drawings, the punch holder 41 is prevented from rotating relative to the upper turret 15 by a suitable means such as a key that may be provided on the punch holder 41 and a key way that may be formed in the upper turret 15, the key and key way being engaged with each other. The upper flange portion 43 of the punch holder 41 is fitted to the lower flange portion 47 of a cylindrical rotary tube 45. A lifter spring 51 is disposed via a thrust bearing 301 between the lower surface of the flange portion 47 of the rotary tube 45 and the bottom surface of a stepped bore 49 formed in the upper turret 15, so that the punch holder 41 is urged upward.

Figure 4:
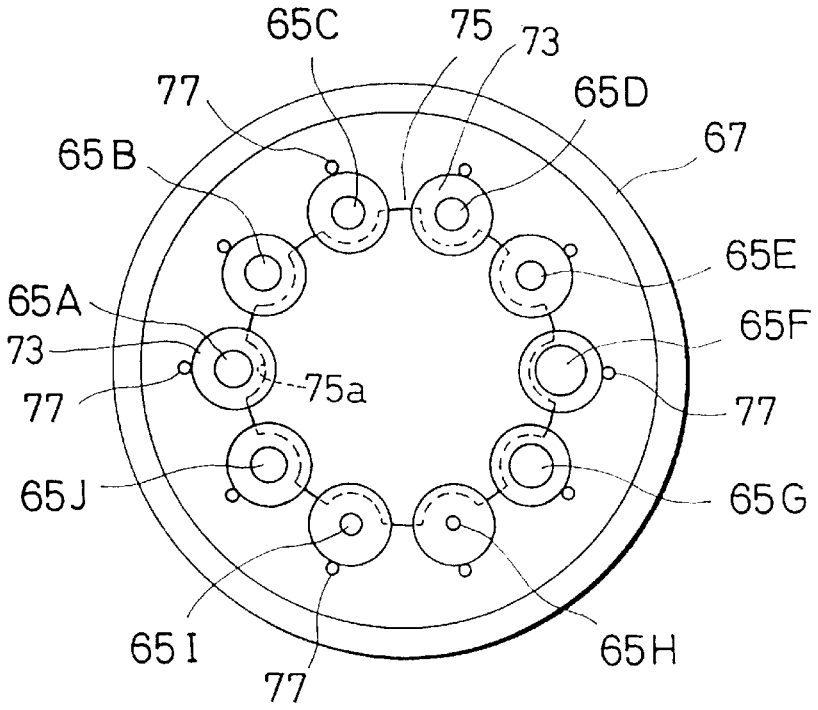
FIG. 4 is a bottom view taken along the lines 400—400 in FIG. 2.

The punch holder 41 is formed with an inner bore 53 opening upward on the upper side thereof. In a bottom portion 55 of this inner bore 53, a plurality of small punches 57 are arranged circularly at regular intervals along the inner circumferential surface of this inner bore 53 so as to be movable up and down. These punches 57 are designated as 57A, 57B, . . . , 57J, because the end shapes thereof are all different from each other, respectively. Each of these punches 57A, 57B . . . , 57J is formed with a head portion 59, a large-diameter portion 61 serving as a guide portion, an intermediate diameter portion 63, and a small-diameter punching portion 65A, 65B, . . . , 65J, respectively in the listed order from the upper end to the lower end. The large-diameter portion 61 is supported by the bottom portion 55 so as to be slidable in the vertical direction. A key 61*a* provided on the large-diameter portion 61 is engaged with a key way 55*a* formed in the bottom portion 55, so that the punch 57 is prevented from rotating relative to the bottom portion 55. The cross section of each of these punch portions 65A, 65B, . . . , 65J is different from each other in diameter size as shown in FIG. 4 or even in cross section (e.g., square, hexagonal, etc.). Therefore it is possible to punch holes of different dimensions or shapes in a workpiece W by appropriately selecting one of the punches 57A, 57B, . . . , 57J.

Further, a guide plate 67 is provided at the lower end of the punch holder 41, and stepped holes 69 are formed circularly in the guide plate 67. Each of hold springs 71 is disposed between the bottom surface of each of the stepped holes 69 and the lower end of the large diameter portion 61 of each of the punches 57 via a washer 303, respectively, in order to urge the respective punches 57A, 57B, . . . , 57J upward. Further, a plurality of circular stripper plates 73 are disposed circularly at the bottom surface of the guide plate 67 to guide the punching portions 65A, 65B, . . . , 65J of the punches 57 by a plurality of holes formed in the stripper plates 73, respectively. Specifically, a retaining plate 75 is fixed to the bottom surface of the guide plate 67, and the stripper plates 73 are engaged with circular-arc-shaped recesses 75*a* (see FIG. 4) formed in the outer circumferential surface of the retaining plate 75. Lock pins 77 (see also FIG. 4) are provided on the guide plate 67 to secure the stripper plate 73 to the guide plate 67.

A ring-shaped punch head holder 79 is provided on the upper portion of the punch holder 41 via a ring 81 so as to be rotatable relative to the punch holder 41 but to be prevented from moving vertically relative thereto.

A central hole 83 is formed at the center of the punch head holder 79 to guide a shaft member 85 so as to be movable up and down. A key 99 fixed to the shaft member 85 is engaged with a key way 79*a* formed in the punch head holder 79 so that a rotation of the shaft member 85 relative to the punch head holder 79 is prevented. To the lower end of the shaft member 85, a disk-shaped striker plate (punch driver) 87 is fixed with a bolt 89. The striker plate 87 is formed with a T-shaped cross-section peripheral groove 91 on the lower surface thereof in such a way that the heads 59 of the punches 57 can be caught by this T-shaped peripheral groove 91. In a portion of the striker plate 87 above the peripheral groove 91, a plurality of through-holes 93 are formed circularly at the regular intervals that correspond to the intervals at which the plurality of punches 57 is arranged on the bottom portion 55 of the punch holder 41, except at a portion 95 as shown in FIG. 2. A portion of the striker plate 87 at the portion 95 will be called as a strike portion 95 hereinafter. This strike portion 95 is indexable to lie over any one of a plurality of punches 57, for instance to lie over the punch 57A by rotating the striker plate 87 relative to the punch holder 41.

A plurality of backup pins 97 is arranged in a the through-holes 93 via washer S, respectively so as to be movable up and down relative to the striker plate 87. It is to be noted that the backup pins 97 are designed such that the lower end thereof are slightly above the head of the punch 57B, 57C, . . . , 57J so as not to contact those heads normally. With this arrangement, the striker plate 87 is rotatable relative to the punches 57A, 57B, . . . , 57J. The punch head holder 79 is formed with a plurality of inner holes 101 each receiving an upper end of each backup pin 97. A backup spring 103 is provided in each of the inner holes 101 to urge the backup pin 97 downward. As will be described in detail in the following, the backup pins 97 and the backup springs 103 serve to suppress vibrations of the punches 57 that are not used during punching, and further to allow the punches 57 to move upward for relief where necessary.

A head plate 105 is fixed to the upper end of the shaft member 85 with a plurality of bolts 107. A stripping spring 109 formed of an elastic material such as urethane rubber for instance is interposed between the lower surface of the head plate 105 and the upper surface of the punch head holder 79.

The punch head holder 79 and the afore-mentioned rotary tube 45 are coupled to each other by a key 111 fixed to the rotary tube 45 and a key way 79*b* formed in the punch head holder 79. Thus the punch head holder 79 is movable up and down, but is prevented from rotating relative to the rotary tube 45. Further a gear tube 115 is rotatably supported by a bearing 113 on the upper surface of the upper turret 15 in such a way as to enclose the outer circumferential surface of the rotary tube 45. This gear tube 115 is formed with a gear 117 on the outer circumferential surface thereof and with a key groove 119 on the inner circumferential surface thereof. A head portion of the key 111 of the rotary tube 45 is engaged with this key groove 119. A gear 123 rotated by a suitable servo motor through a suitable gear transmission mechanism (indexing device) 121 is in mesh with the gear 117.

Figure 5:
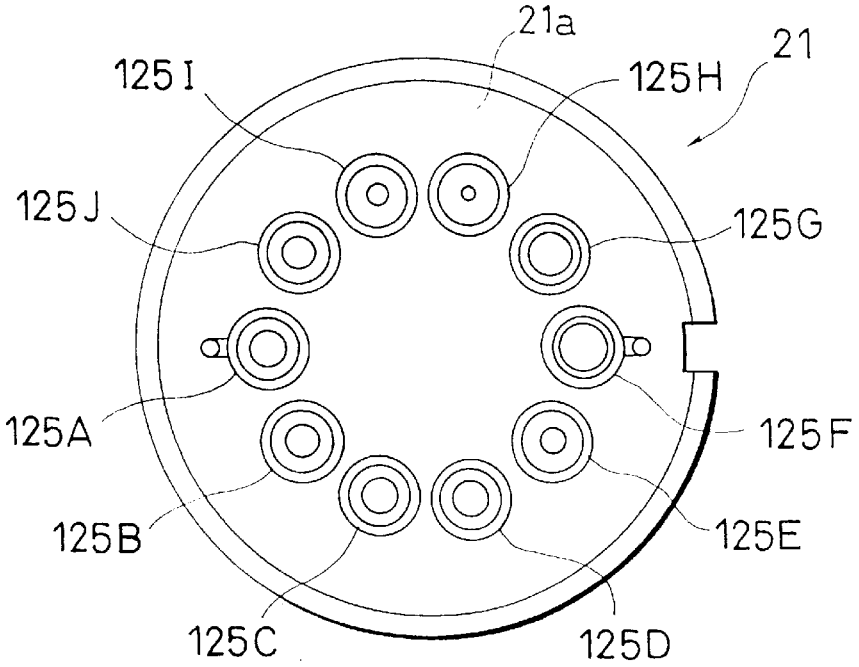
FIG. 5 is a top view taken along the lines 500—500 in FIG. 2.

On the other hand, on the lower turret 23, a die assembly 21 is disposed in oppositional positional relationship with respect to the punch assembly 13. A plurality of dies 125 are arranged on the die assembly 21. In more detail, a plurality of dies 125A, 125B, . . . , 125J are arranged so as to face the punches 57A, 57B, . . . , 57J, as shown in FIG. 5. The dies 125A, 125B, . . . , 125J are formed with die holes 127A, 127B, . . . , 127J, respectively. The die holes 127A, 127B, . . . 127J are adapted to receive the lower end portions 65A, 65B, . . . , 65J of the punches 57, respectively.

Figure 3:
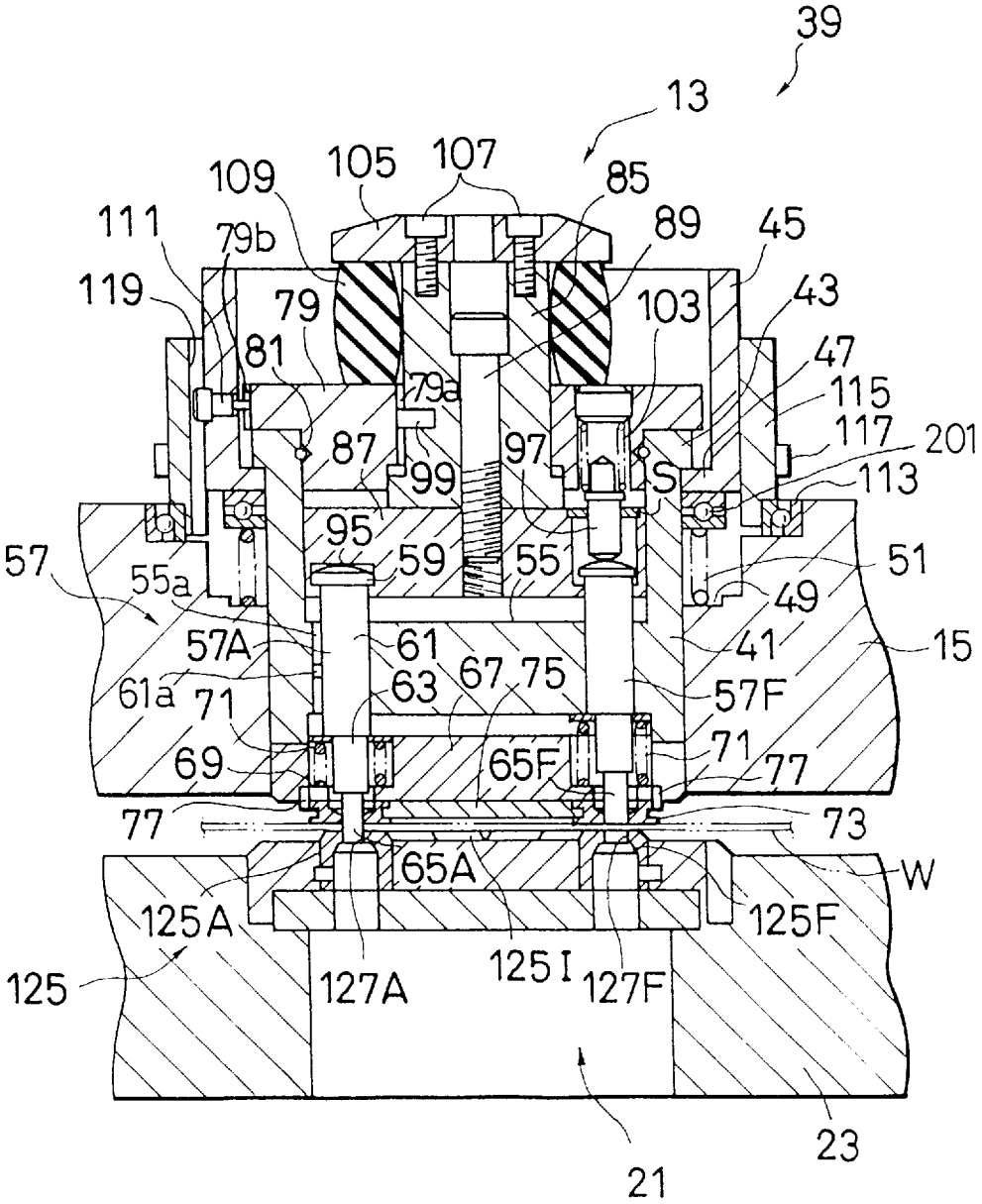
FIG. 3 is a cross-sectional view of the multiple tool shown in FIG. 2, showing the multiple tool in a punching position.

The operation of the multiple tool 39 for the punch press according to the present invention will be described hereinbelow with reference to further FIGS. 2 and 3.

First, the upper and lower turrets 15 and 23 are rotated to bring any required punch assembly 13 and the die assembly 21 under the striker 27. Then the movable table 31 and the carriage 35 are moved to locate a suitable portion of the workpiece W above the required die 125A, for instance. When the indexing device 121 is actuated, the gear tube 115 is rotated so that the rotation thereof is transmitted from the rotary tube 45 to the punch head holder 79 and further to the shaft member 85 and striker plate 87. Therefore it is possible to index the strike portion 95 of the striker plate 87 to lie over the required punch 57A corresponding to required die 125A, for instance.

After the strike portion 95 has been indexed, the ram 29 of the punch press is actuated to move down the striker 27 for striking the head plate 105. As a result, the punch head holder 79, the punch holder 41, the rotary tube 45, and the shaft member 85 and the striker plate 87 are moved down together against the urging force of the lifter spring 51, without compressing the stripping spring 109. Accordingly, the stripper plates 73 are brought into contact with the workpiece W, and the workpiece W is sandwiched between the die 125 and the punch holder 41. Thereafter, when the striker 27 is further moved downward, only the shaft member 85 and the striker plate 87 are further moved downward while compressing the stripping spring 109.

At this time, the strike portion 95 strikes the head 59 of the punch 57A, and the punch 57A is moved downward while compressing the hold spring 71. Thus as shown in FIG. 3, the punching portion 65A of the punch 57A projects downward from the lower surface of the stripper plate 73 and through the workpiece W into the die hole 127A of the die 125A.

Here, when the striker plate 87 is moved downward after the stripper plate 73 comes into contact with the workpiece W, the punches 57B, 57C, . . . , 57J that are not used for the punching are moved upward relative to the striker plate 87. Accordingly the backup pins 97 urged by the backup springs 103, respectively are brought into contact with the head portions 59 of the punches 57B, . . . , 57J so that these punches 57B, . . . , 57J are prevented from bouncing upward despite vibrations due to the punching transmitted thereto. Further the elastic force of the hold spring 71 is designed to be stronger than that of the backup spring 103. Thus the inactive punches 57B, . . . , 57J that are not used for the punching are prevented from projecting downward out of the lower surface of the stripper plates 73.

When the ram 29 is actuated to move the striker 27 upward, the shaft member 85 and the striker plate 87 are first moved upward by a restoration force of the stripping spring 109. Thus the punch 57A whose lower end portion 65A was inserted into the die hole 127A is moved upward to the position flush with the other remaining punches 57B, . . . , 57J because the head portion 59 of the punch 57A is caught by the peripheral groove 91 formed in the striker plate 87.

After the striker 27 and the shaft member 85 and striker plate have been further moved upward by the action of the stripping spring 109, the punch holder 41, the rotary tube 45 and the punch head holder 79 all move upward by the restoration force of the lifter spring 51. Thus the stripper plate 73 is moved away from the workpiece W.

Thereafter, when the striker 27 is further moved upward to an upper dead point, the striker 27 is moved away from the head plate 105.

Here it is noted that the upper surface of the striker plate 87 is urged to abut the lower surface of the punch head holder 79 by the restoration force of the stripping spring 109. The punches 57B, 57C,. . . , 57J is therefore reliably located in the peripheral groove 91, and the backup pins 97 are in contact with the washers S located at the upper surface of the striker plate 87, respectively. Thus the lower ends of the backup pins 97 are away from the heads 59 of the punches 57B, 57C . . . , 57J, respectively, as shown in FIG. 2. Therefore it is easy to rotate the striker plate 87 to index the strike portion 95 to locations above any one of the punches 57A, 57B, . . . , 57J without interfering with the lower ends of the backup pins 97. Here, it is also to be noted that since the peripheral groove 91 engaged with the head portions 59 of the punches 57 is of circular shape, the striker plate 87 can rotate relative to the punches 57.

Further, since the final gear 123 of the indexing device 121 is in mesh with the gear 117 of the gear tube 115, it is possible to index the strike portion 95 to lie over any required punch 57A, for instance by rotating the striker plate 87.

As described above, in the first embodiment of the multiple tool according to the present invention, since a plurality of punches 57 are housed in the punch assembly (upper multiple tool) 13 and further arranged circularly within the punch holder 41 fitted to the upper turret (upper die holding member) 15 so as to be movable up and down, the multiple tool is simple in structure and easy to secure the processing precision, thus improving the punching quality. Further, since the structure is simple, the manufacturing cost can be reduced.

In addition, since the punching processing can be made by indexing the strike portion 95 to a location above any required punch (e.g., 57A) by use of the indexing device 121, to strike the required punch, without moving the remaining punches up and down within the punch holder 41, it is possible to locate the workpiece W accurately at the required punch position accurately, irrespective of the positions of the remaining punches, thus improving the working efficiency of the punching processing.

Further, since the punching processing can be made by indexing the strike portion 95 to a position above any required punch (e.g., 57A), by use of the indexing device 121, without moving the striker and the die assembly 21, the structure is further simplified for further reduction of manufacturing cost.

Figure 6:
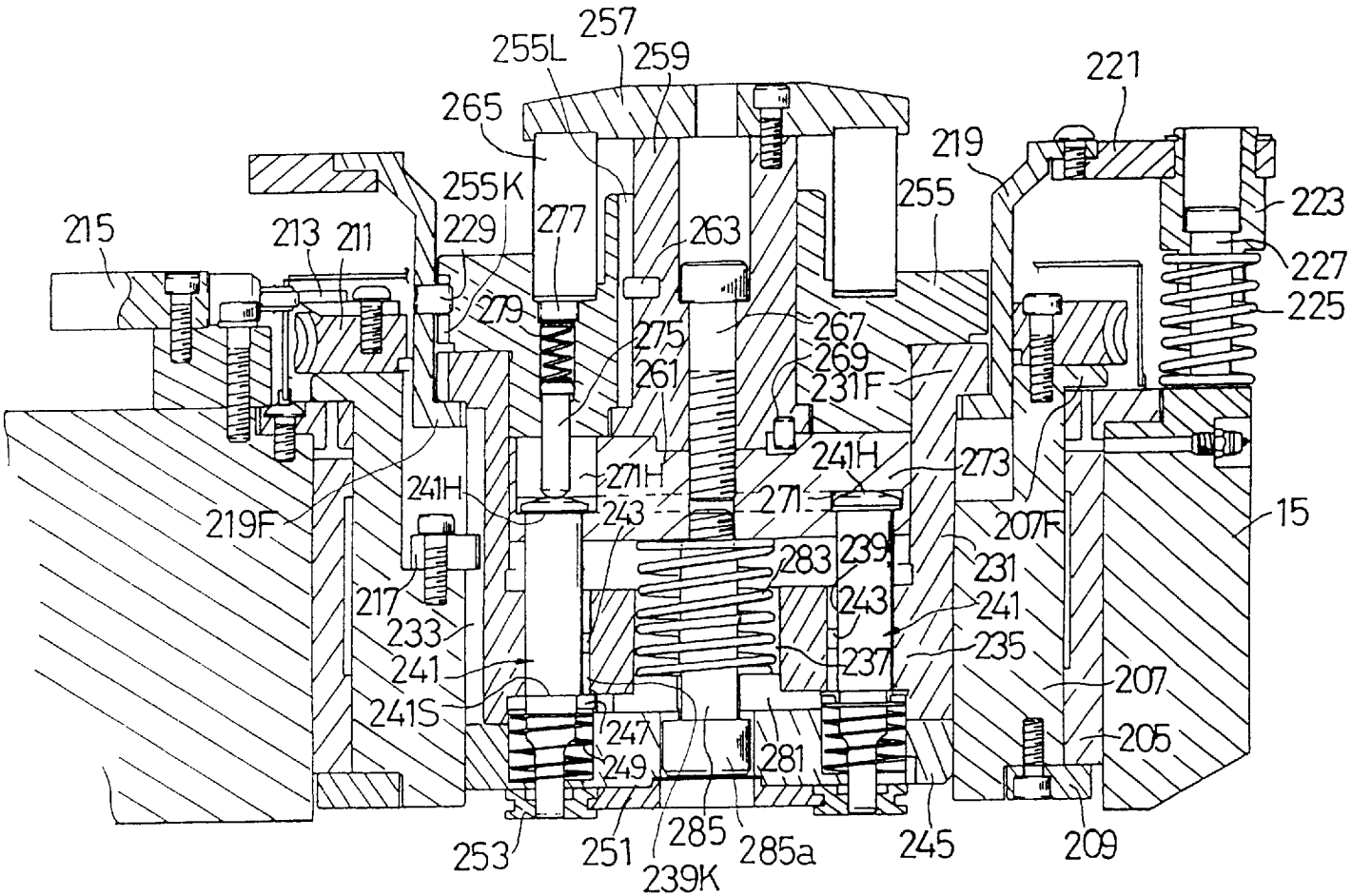
FIG.6 is a sectional view of a second embodiment of a multiple tool of the present invention.

FIG. 6 shows a punch assembly 201 of a second embodiment of the multiple tool for the punch press. In FIG. 6, the punch assembly 201 is mounted on the upper tool holder body 15 such as, for example, the upper turret on the turret punch press 1.

A cylindrical outer pipe 205 is integrally installed on the holder body 15 by a plurality of bolts (omitted from the drawing). A cylindrical rotatable holder 207 is supported in a freely rotatable manner on the outer pipe 205.

A flange 207F which is provided on the upper section of the rotatable holder 207 is slidably supported on the upper surface of the outer pipe 205. A ring member 209 is integrally mounted on the lower section of the rotatable holder 207 by a plurality of bolts. The outer pipe 205 is therefore interposed between the flange 207F and the ring member 209.

Accordingly, the rotatable holder 207 is supported on the outer pipe 205 so as to be restrained from any vertical movement and to be able to rotate. A ring-shaped worm wheel 211 is integrally mounted on the upper surface of the rotatable holder 207 by a plurality of bolts to cause the rotatable holder 207 to rotate. The worm wheel 211 engages a worm gear (omitted from the drawing) which is supported in a freely rotatable manner on the holder body 15. This worm gear is rotatably driven by a servomotor (also omitted from the drawing). Accordingly, the worm wheel 211 can be indexably positioned at an optional rotational position relative to a home position by driving the servomotor under a suitable feed-back control.

A home position dog 213 is provided on the worm wheel 211 so that the worm wheel 211 can be easily positioned at the home position. A sensor 215, such as a limit switch or the like, is provided on the holder body 15 for outputting a home position signal to a control device when the dog 213 is detected. Accordingly, when the sensor 215 detects the dog 213 during the rotation of the worm wheel 211, the worm wheel 211 can be reliably positioned at the home position by halting the rotation of the worm wheel 211.

The punch assembly 201 is removably mounted on the rotatable holder 207. A positioning key 217 is integrally mounted on the inner peripheral surface of the rotatable holder 207 by bolts to prevent the rotation of the punch assembly 201 relative to the rotatable holder 207.

A cylindrical lifter ring 219 is vertically movably provided on the holder body 15 in order to support the punch assembly 201, allowing free vertical movement thereof with respect to the rotatable holder 207. In more detail, a ring member 221 is integrally connected to the outside of the top end of the lifter ring 219 by a plurality of bolts. The ring member 221 is in turn integrally fitted to a cylindrical spring seat 223 at a plurality of locations. A plurality of lifter springs 225 is elastically installed between the spring seat 223 and the holder body 15. Accordingly, the spring seat 223, the ring member 221, and the lifter ring 219 are all urged upward by the lifter springs 225.

The upward movement of the spring seat 223 is restrained by restraining bolts 227 which penetrate the spring seat 223 from its upper side and are screwed into the holder body 15.

The lower end of the lifter ring 219 extend to an elevation below the worm wheel 211 and is positioned inside the rotatable holder 207. An inside flange 219F which is formed on the lower end of the lifter ring 219, projecting to the inside supports the punch assembly 201.

In addition, a key 229 is provided at a vertically middle portion of the lifter spring 219, projecting to the inside.

The punch assembly 201 includes a cylindrical punch holder 231 detachably mounted on the rotatable holder 207. A vertical keyway 233 is formed in the outer peripheral surface of the punch holder 231 to receive the positioning key 217. A flange section 231F provided at the upper end of the punch holder 231 is supported by the inside flange 219F of the lifter ring 219.

A punch mounting section 235 having a thick wall is provided on a lower inside section of the punch holder 231. A through-hole 237 is formed at the center of the punch mounting section 235. A plurality of vertically penetrating punch mounting holes 239 is provided concentrically about the through-hole 237 in such a way as to be circumferentially arranged at regular intervals.

One of a plurality of small diameter punches 241 is installed in a freely vertically movable manner in each of the punch mounting holes 239. Specifically, the vertically middle portion of the punch 241 is supported by the thick punch mounting section 235 to reliably hold the punch 241 and to prevent the same tilting relative to the vertical axis during punching. A key 243 mounted on each punch 241 engages with a keyway 239K formed in the punch mounting hole 239. Thus each of the punches 241 is prevented from rotating relative to the punch holder 231. A ring-shaped spring seat plate 245 is mounted on the lower surface of the punch holder 231 by a plurality of bolts to support vertically lower ends of the punches 241. Specifically, a hold spring 249 is elastically installed between the seat plate 245 and each of a plurality of ring members 247 each engaging with a stepped section 241S of each punch 241, for upwardly urging the punches 241 relative to the punch holder 231.

A guide holder plate 251 is installed on the lower surface of the seat plate 245, and a ring-shaped punch guide 253 for laterally guiding the lower end of each punch 241 is removably supported on the guide holder plate 251. The configurations of the guide holder plate 251 and the punch guide 253 are the same as that of the previously described first embodiment of the punch assembly and therefore further detailed explanation is omitted here.

A punch head holder 255 is supported on the upper section of the punch holder 231 for rotating with respect to the punch holder 231. A vertical keyway 255K which receives the key 229 on the lifter ring 219 is formed on the outer peripheral surface of the punch head holder 255.

A shaft member 259, on the upper end of which a head plate 257 is integrally mounted, is provided to penetrate the center section of the punch head holder 255 in a manner allowing free vertical movement relative thereto. A key 263 provided in the shaft member 259 engages a keyway 255L formed in the punch head holder 255. Thus the shaft member 259 is prevented from rotating relative to the punch head holder 255. That is, the shaft member 259 is supported in the punch head holder 255 in a manner allowing vertical movement only. In addition, a stripper spring 265 made of elastic material with a spring force stronger than the lifter spring 225 is elastically installed between the punch head holder 255 and the head plate 257.

A striker plate 261 for striking the punches 241 is integrally mounted on the lower end of the shaft member 259. The striker plate 261 is formed in the shape of a disk which is rotatably fitted in the punch holder 231. The striker plate 261 is integrally joined to the lower end of the shaft member 259 by a bolt 267 which axially penetrates the shaft member 259. A pin 269 mounted on the shaft member 259 engages with a keyway 261K formed in the striker plate 261. Thus relative rotation between the striker plate 261 and the shaft member 259 is reliably restrained.

A peripheral groove 271 with a T-shaped cross section for engaging the heads 241H of the punches 241 is formed in the lower surface of the striker plate 261. Further, a plurality of vertical through-holes 271H are formed in the striker plate 261 at locations above the heads 241 of the punches 241 engaged in the peripheral groove 271, except for one location above one punch 241, and a striker section 273 is formed at the one location where the through-hole 271H is not provided.

Backup pins 275 for depressing the head sections 241H of the punches 241 are provided in a freely vertically movable manner at a plurality of locations in the punch head holder 255 above the through-holes 271H. The backup pins 275 are urged downward by a backup spring 279 which is elastically installed between a blind screw 277 and the head of the backup pins 275.

A ring-shaped spring seat 281 is secured between the lower surface of the punch holder 231 and the spring seat plate 245. An elastic member 283 is elastically installed between the spring seat 281 and the striker plate 261 to maintain the striker plate 261 at a specified elevation during assembly of the punch assembly 201, as described in detail in the following.

In addition, an upward movement restraining member 285 such as a bolt or the like passes through the spring seat 281 from the lower side and is screwed to the striker plate 261 so that the striker plate 261 and the like is prevented from being removed from the punch holder 231.

Dies (omitted from the drawing) corresponding to each of the punches 241 are supported in a die holder (omitted from the drawing) supported in a freely rotatable manner on the lower holder body (e.g. the lower turret) opposing the holder body 15. The die holder rotates in the same direction and synchronously with the rotatable holder 207. The configuration of the die holder and the structure by which the die holder rotates in the same direction and synchronously with the rotatable holder 207 are commonly known, and therefore a further detailed explanation is omitted here.

In a structure such as that outlined above, when the worm wheel 211 is rotatably driven by the servomotor the punch holder 231 is caused to rotate via the rotatable holder 207 and the positioning key 217. The punch head holder 255 is on the other hand prevented from rotating with respect to the holder body 15 via the lifter ring 219 and the key 229. Accordingly, the heads 241H of the punches 241 relatively move along the peripheral groove 271 in the striker plate 261 as a result of the rotation of the punch holder 231. Therefore a desired punch 241 can be indexably positioned under the striker section 273 of the striker plate 261.

The die holder supporting the dies corresponding to the punches 241 is synchronously rotated and indexably positioned in the same horizontal position, so that a die corresponding to the punch 241 is moved and positioned while maintaining a corresponding relationship with the punch 241.

In this manner, after the desired punch 241 has been positioned under the striker section 273, the head plate 257 is struck by the striker 27 of the punch press 1 (see FIG. 1). Thereafter, when the head plate 257 descends against the elastic force of the lifter spring 225 and the stripper spring 265, the striker plate 261 descends integrally with the shaft member 259 to strike the desired punch 241. Thus the punch 241 is caused to descend against the elastic force of the hold spring 249.

During the descending of the striker plate 261, the punches 241 which are positioned below the through-holes 271H are pushed upward together with the backup pins 275 by the action of the hold springs 249. This is because the elastic force of the hold spring 249 is greater than the elastic force of the backup spring 279. Accordingly, during punching by the desired punch 241 positioned below the striker section 273, the other punches 241 is reliably prevented from projecting downward from the punch guide 253 so that there is no concern about impact or damage to the workpiece (omitted from the drawing).

When the striker ascends after the punching operation on the workpiece by the specified punch 241, the punch 241 is withdrawn from the workpiece by the stripper spring 265. The punch holder 231 is also caused to ascend by means of the lifter springs 225 to return to its origin position.

When the punches 241 are to be exchanged, the entire punch assembly 201 is first removed from the rotatable holders 207 and the lifter rings 219 by lifting up the head plate 257.

During the above-mentioned lifting of the head plate 257, the punch holder 231 is joined to the striker plate 261 by the upward movement restraining member 285 so that the punch holder 231 is prevented from being detached from the striker plate 261, which is fixed to the head plate 257 through the shaft member 259. Accordingly, the punch holder 231 is never detached from the punch head holder 255, the striker plate 261, and the like so that handling of the entire punch assembly 201 is very easy.

After the punch assembly 201 is removed from the rotatable holder 207 or the like, the head plate 257, the shaft member 259, and the punch head holder 255 and the like are removed from the striker plate 261 and the punch holder 231 by loosing the bolt 267. Accordingly, the punch 241 can be removed from the punch holder 231 via the through-hole 271H formed in the striker plate 261.

In this embodiment, even after the punch head 259, shaft member 259 and punch head holder 255 and the like have been removed from the striker plate 261 and the punch holder 231, the striker plate 261 is upwardly urged by the elastic member 283. In addition, a head 285*a* formed at the lower end of the upward movement restraining member 285 which is screwed into the lower section of the striker plate 261 is engaged with the spring seat 281. Accordingly; the striker plate 261 is maintained at a predetermined elevation with respect to the punch holder 231 so that the heads 241H of the punches 241 are reliably positioned in the peripheral groove 271 in the striker plate 261 without entering the through-hole 271H. The striker plate 261 can therefore easily rotate relative to the punch holder 231, and a punch 241 positioned under the striker section 273 can be easily brought under one of the through-hole 271H to be removed and exchanged therefrom.

Further, the striker plate 261 is supported and upwardly urged by the elastic member 283, and therefore the striker plate 261 does not incline relative to the punch holder 231. Accordingly, the striker plate 261 can easily rotate relative to the punch holder 231, so that all the punches 241 in the punch holder 231 are easily removed and exchanged.

After a predetermined number of punches 241 have been replaced, the punch head holder 255 is once again fitted in the punch holder 231, after which the striker plate 261 is again integrally joined to the shaft member 259 by tightening the bolt 267. At this time, the lower end of the bolt 267 easily reaches a female-threaded groove in the striker plate 261 because the striker plate 261 is held upward by the spring 283. Thus the joining of the shaft member 259 to the striker plate 261 is easily performed.

The tightening of the bolt 267 can be reliably and easily performed by supporting the upward movement restraining member 285 by a suitable tool.

Figure 7:
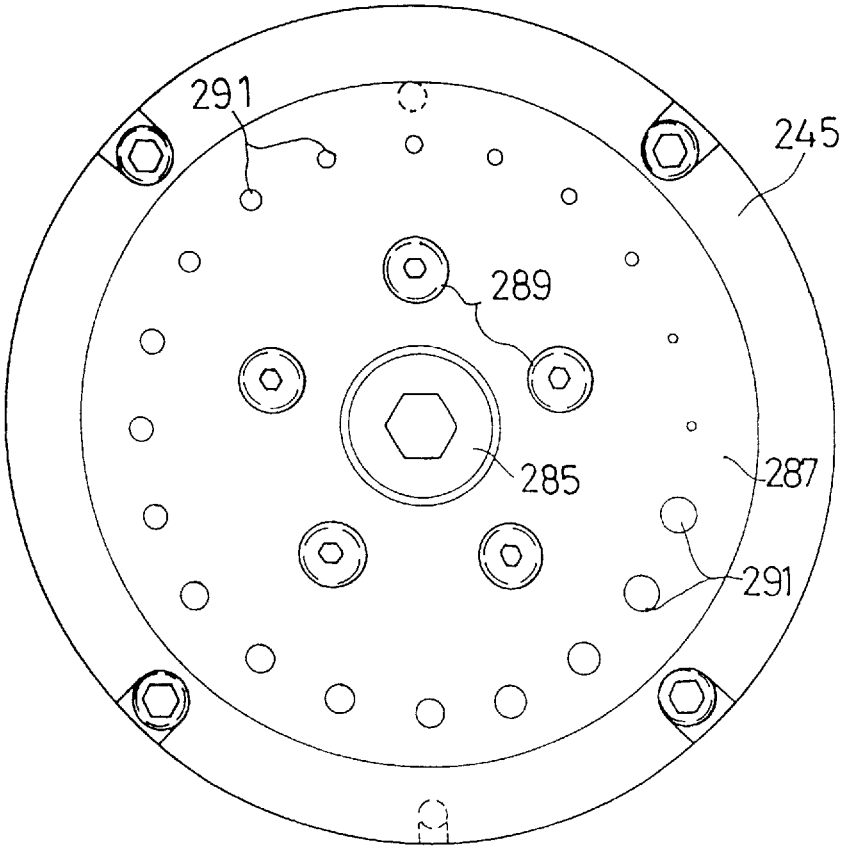
FIG.7 is a bottom view of a third embodiment of the present invention.

FIG. 7 is a bottom view showing a third embodiment of the present invention wherein a disk-shaped solid pressure plate 287 is mounted on the bottom surface of the spring seat plate 245 by a plurality of bolts 289 in place of the guide holder plate 251 and the punch guides 253.

A guide hole 91 for guiding the lower end of the punches 241 is provided on the pressure plate 287 for each punch 241. Specifically, the guide hole 91 is designed such that clearance between the lower end of each punch 241 and the wall of the guide hole 91 is very small. Thus even when a lateral component force acts on the lower end of the punch 241, a possible lateral deviation of the lower end is reliably restrained, thereby a possible galling between the lower end and the die being prevented. Such lateral component force acts on the lower end of the punch in particular during a so-called nibbling processing.

The present invention is not restricted to this embodiment. Other modes of the invention can be implemented by making suitable changes. Specifically, the upper and lower sections of the upward movement restraining member 285 can be reversed; for example, a screw section is formed at the lower end of the member 285 to be screwed to the spring seat 281 and a head is formed at the upper end of the member 285 to be engaged to a engage section formed in the striker plate 261.

As can be understood from the above explanation, it is possible by means of the present invention to reliably prevent the possible disconnection of the striker plate 261 from the punch holder 231 because the upward movement restraining member 285 is provided between the punch holder 231 and the striker plate 261.

In addition, during replacement of the punches, the striker plate 261 is supported by the elastic member 283 so as not to incline relative to the punch holder 231. Accordingly, the striker plate 261 can easily rotate in the punch holder 231, so that the punches 241 can be easily removed and replaced. In addition, the punch assembly can be easily assembled.

The presser plate made of a solid plate is installed on the lower surface of the punch holder, for guiding the lower end of the punches in a freely vertically movable manner. Therefore the lower end of the small diameter punch can be restrained from deviating laterally by a lateral component force during a nibbling operation, for example, and the galling between the lower end of the punch and the die can be prevented.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A multiple tool mounted on a rotatable holder supported in a freely rotatably driven manner on a holder body, said multiple tool comprising:

a punch holder having a lower surface;

a punch guide secured to the lower surface of the punch holder;

a plurality of punches supported in a vertically movable manner on the punch holder, each punch being provided with a head; and a striker plate provided in the punch holder in a rotatable and vertically movable manner relative to the punch holder;

wherein the striker plate has a lower surface with a peripheral groove formed thereon for engaging the heads of the punches, and wherein a striker section for selectively striking one of the punches on the punch holder is formed at a predetermined location along the peripheral groove, and wherein through-holes are formed at a plurality of predetermined locations along the peripheral groove for allowing the heads of the punches, other than the punch struck by the striker section, to move upward relative to the striker plate during a punching operation;

said multiple tool further comprising:

a punch head holder provided above the striker plate, said punch head holder being non-rotatable relative to the striker plate;

a backup pin provided in the punch head holder at a position above each through-hole, the head of each punch being pressed downward by a lower end of the backup pin;

a pressure spring provided between the punch head holder and the backup pin for urging the backup pin downward, the pressure spring having a spring constant; and a holder spring provided between the punch guide and the punch for urging the punch upward, the holder spring having a spring constant which is greater than the spring constant of the pressure spring, the holder spring prevents the punches under the through-holes from projecting downward from the lower surface of the punch guide during the punching operation, and from contacting a workpiece, whereby to prevent impact on the workpiece during a punching operation.

2. A multiple tool comprising:

a punch holder having an upper section and mountable on a rotatable holder supported in a freely rotatable driven manner on an upper tool holder body;

a plurality of punches supported in a freely vertically movable manner on the punch holder; and a striker plate provided in the punch holder in a rotatable and vertically movable manner relative to the punch holder;

wherein the striker plate has a lower surface with a peripheral groove formed thereon for engaging the heads of the punches, and further comprising a striker section for selectively striking one of the punches on the punch holder, said striker section formed at a predetermined location along the peripheral groove, and further comprising through-holes for allowing the heads of the punches, other than the punch struck by the striker section, to move upward relative to the striker plate during a punching operation, said through-holes formed at a plurality of predetermined locations along the peripheral groove;

said multiple tool further comprising:

a punch head holder supported on the upper section of the punch holder and rotatable relative to the punch holder, the punch head holder being engaged with the upper tool holder body for preventing rotation relative to the upper tool holder body;

a punch head;

a removable fastener for removably connecting said punch head to the striker plate;

a stripper spring provided between the punch head holder and the punch head for urging the punch head to move upward;

an elastic member provided between the punch holder and the striker plate for urging the striker plate upward relative to the punch holder; and an upward movement restraining member for preventing vertical movement of the striker plate relative to the punch holder, the upward movement restraining member being vertically movable relative to the punch holder.

3. A multiple tool as claimed in claim 2, wherein a presser plate (287) for guiding lolwer ends of the punches in a freely vertical manner is removably attached to a lower surface of the punch holder, and wherein the presser plate comprises a solid plate.

4. A multiple tool as claimed in claim 2, wherein the upward movement restraining means comprises a bolt which has an upper end fi8xed to the striker plate, a middle section passing through a hole formed in the punch holder, and a lower end which is engageable with an engage section provided in the punch holder.

5. A multiple tool as claimed in claim 4, wherein a presser plate (287) for guiding lower ends of the punches in a freely vertical manner is removably attached to a lower surface of the punch holder, and wherein the presser plate comprises a solid plate.

* * * * *

UNITED STATES PATENT AND TRADEMARK OFFICE

CERTIFICATE OF CORRECTION

PATENT NO. : 5,848,563
DATED : December 15, 1998
INVENTOR(S) : Hiroshi Saito

It is certified that error appears in the above-identified patent and that said Letters Patent is hereby corrected as shown below:

Column 14, (claim 3), line 29, change "lolwer" to --lower--.

" (claim 4), line 34, change "means" to --member--;

" (claim 4), line 35, change "fi8xed" to --fixed--;

" (claim 4), line 37, change "engage" to --engagement--.

Signed and Sealed this

Tenth Day of August, 1999

*Attest:*

Q. TODD DICKINSON

*Attesting Officer*

*Acting Commissioner of Patents and Trademarks*